US008033216B2

(12) United States Patent
Chen

(10) Patent No.: US 8,033,216 B2
(45) Date of Patent: Oct. 11, 2011

(54) CARTRIDGE DEVICE

(75) Inventor: Tung-Chin Chen, Taipei (TW)

(73) Assignee: ATMA Champ Enterprise Corporation, Taipei (TW)

( * ) Notice: Subject to any disclaimer, the term of this patent is extended or adjusted under 35 U.S.C. 154(b) by 448 days.

(21) Appl. No.: 12/265,442

(22) Filed: Nov. 5, 2008

(65) Prior Publication Data

US 2010/0034572 A1 Feb. 11, 2010

(30) Foreign Application Priority Data

Aug. 7, 2008 (TW) ..... 97130143 A

(51) Int. Cl.
*B41F 15/00* (2006.01)

(52) U.S. Cl. ..... 101/114; 101/118; 101/480

(58) Field of Classification Search ..... 101/114, 101/123, 124, 126, 129, 477, 479, 480, 118
See application file for complete search history.

(56) References Cited

U.S. PATENT DOCUMENTS 2,610,577 A * 9/1952 Heintges ..... 101/115
4,195,567 A * 4/1980 Mitter ..... 101/115
4,911,070 A * 3/1990 Miske et al. ..... 101/126
5,107,760 A * 4/1992 Pratt ..... 101/115
5,355,791 A * 10/1994 Benedetto et al. ..... 101/126
5,809,360 A * 9/1998 Blake et al. ..... 396/517
6,152,031 A * 11/2000 DeCruz ..... 101/129
7,610,855 B2 * 11/2009 Burgess et al. ..... 101/477

* cited by examiner

*Primary Examiner* — Ren Yan
(74) *Attorney, Agent, or Firm* — Muncy, Geissler, Olds & Lowe, PLLC

(57) ABSTRACT

A cartridge device applied to production lines for automatic screen printing is revealed. The cartridge device includes a frame, a plurality of cartridges for loading articles to be printed, two cartridge lifting members for driving the cartridge to move up/down, two cartridge convey member for driving the cartridge move horizontally, two printed substrate (articles) delivery members for delivering the articles to be printed, and two shift mechanisms for taking out or putting in the articles to be printed from the cartridge or the printed substrate delivery members. By one shift mechanism, the article to be printed on a work line is moved from the printed substrate delivery member into the cartridge for running material collection or the article to be printed is moved from the cartridge to the printed substrate delivery member for performing material feeding. Thus the two work lines of the production line can perform automatic material feeding, collection and storage simultaneously or respectively.

10 Claims, 12 Drawing Sheets

CARTRIDGE DEVICE

BACKGROUND OF THE INVENTION

The present invention relates to a cartridge device applied to production lines for automatic screen printing, especially to a cartridge device with a plurality of cartridges and a plurality of transmission mechanisms toward different directions so as to make the production lines perform automatic material feeding, collection and storage simultaneously or respectively.

In early days, an automatic feeding device of the screen printing machine uses a carrier plate to precisely send the printed articles that have been corrected to a printing unit for performing printing process. This is a material feeding process. At the same time, the articles already printed are synchronously sent to a material collection area (this is material collection process). However, once the material feeding device is stopped and maintained, the screen printing machine also needs to be shut down.

Refer to FIG. 1, recently the material feeding device for the screen printing machine further uses a cartridge 10*a* to lodge articles to be printed. A convey member sends the cartridge 10*a* to a material load area and then the articles to be printed in the cartridge 10*a* is pushed out by a thrust member to another convey member. However, while the thrust member moving the articles to be printed, there is a friction between the bottom of the articles to be printed and the cartridge that causes abrasion. However, while the thrust member pushes the articles to be printed, the friction between the bottom of the articles and the cartridge causes abrasion. For the articles to be printed on both sides, the negative effect is especially obvious. Moreover, the material feeding device generally includes two separate work lines for material feeding and material collection. Thus no matter the cartridge 10*a* is empty or full, it is replaced manually.

SUMMARY OF THE INVENTION

Therefore it is a primary object of the present invention to provide a cartridge device applied to production lines for automatic screen printing consists of a frame, a plurality of cartridges, two cartridge lifting members, two cartridge convey members, two printed substrate (articles) convey members and two shift mechanisms. The plurality of cartridges are for loading articles to be printed, the two cartridge lifting members arranged symmetrically on two sides of the frame are for driving the cartridge to move up/down, the two cartridge convey member disposed on rear side of the cartridge lifting member are for driving the cartridge move horizontally, the two printed substrate (articles) delivery members disposed on front end of the cartridge lifting member are for delivering the articles to be printed, and the two shift mechanisms respectively arranged over and corresponding to the printed substrate delivery member for taking out or putting in the articles to be printed from the cartridge to the printed substrate delivery member or in the opposite direction. By one shift mechanism, the article to be printed on a work line is moved from the printed substrate delivery member into the cartridge for running material collection or the article to be printed is moved from the cartridge to the printed substrate delivery member for performing material feeding. Thus the two work lines of the production line can perform automatic material feeding, collection and storage simultaneously or respectively. Furthermore, if one of the work lines is suspended for maintenance, the other work line continues material feeding, collection or storage.

DETAILED DESCRIPTION OF THE PREFERRED EMBODIMENT

Figure 1:
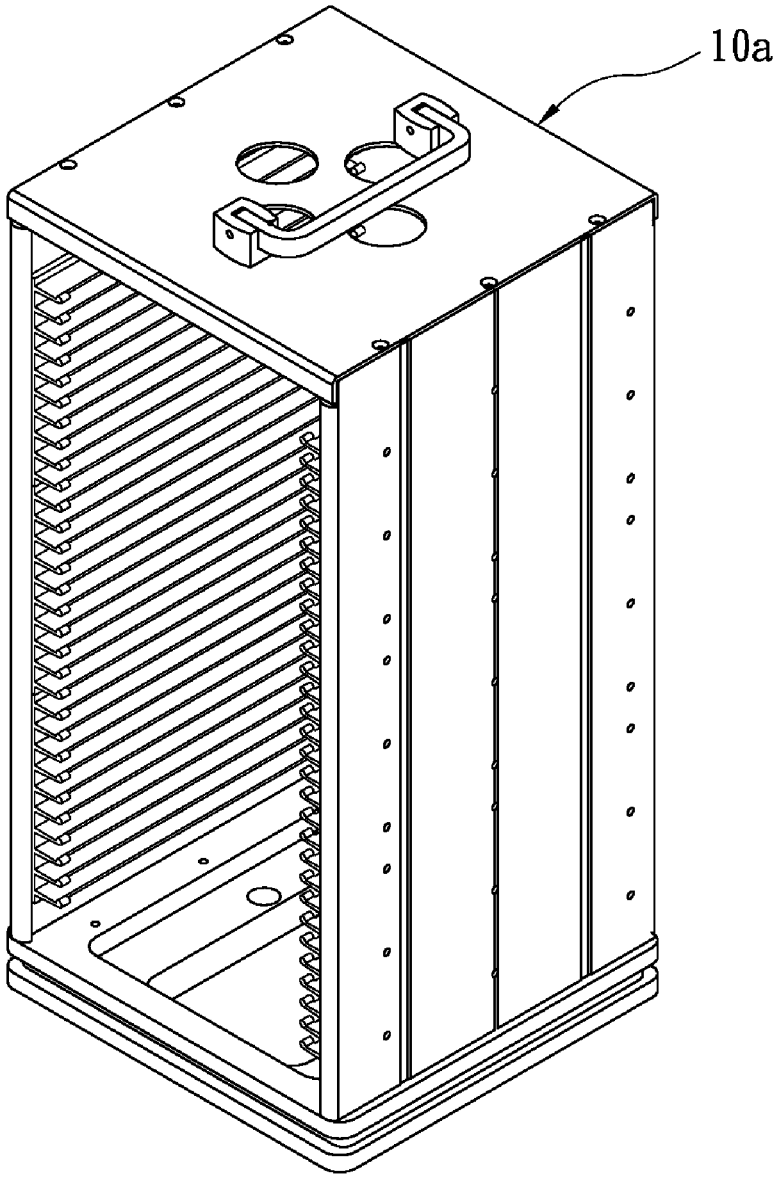
FIG. 1 is a perspective view of a conventional cartridge device.

Refer from FIG. 2 to FIG. 12, a cartridge device 1 according to the present invention applied to production lines for automatic screen printing includes a frame 2, a plurality of cartridges 10, two cartridge lifting members 20, two cartridge convey members 30, two printed substrate (articles) delivery members 40 and two shift mechanisms 50. The frame 2 is made from metal such as aluminum extrusion for receiving above parts 20, 30, 40, 50, saving disposition space, and the cartridge device can be moved or changing positions according to requirements of the production lines.

Figure 4:
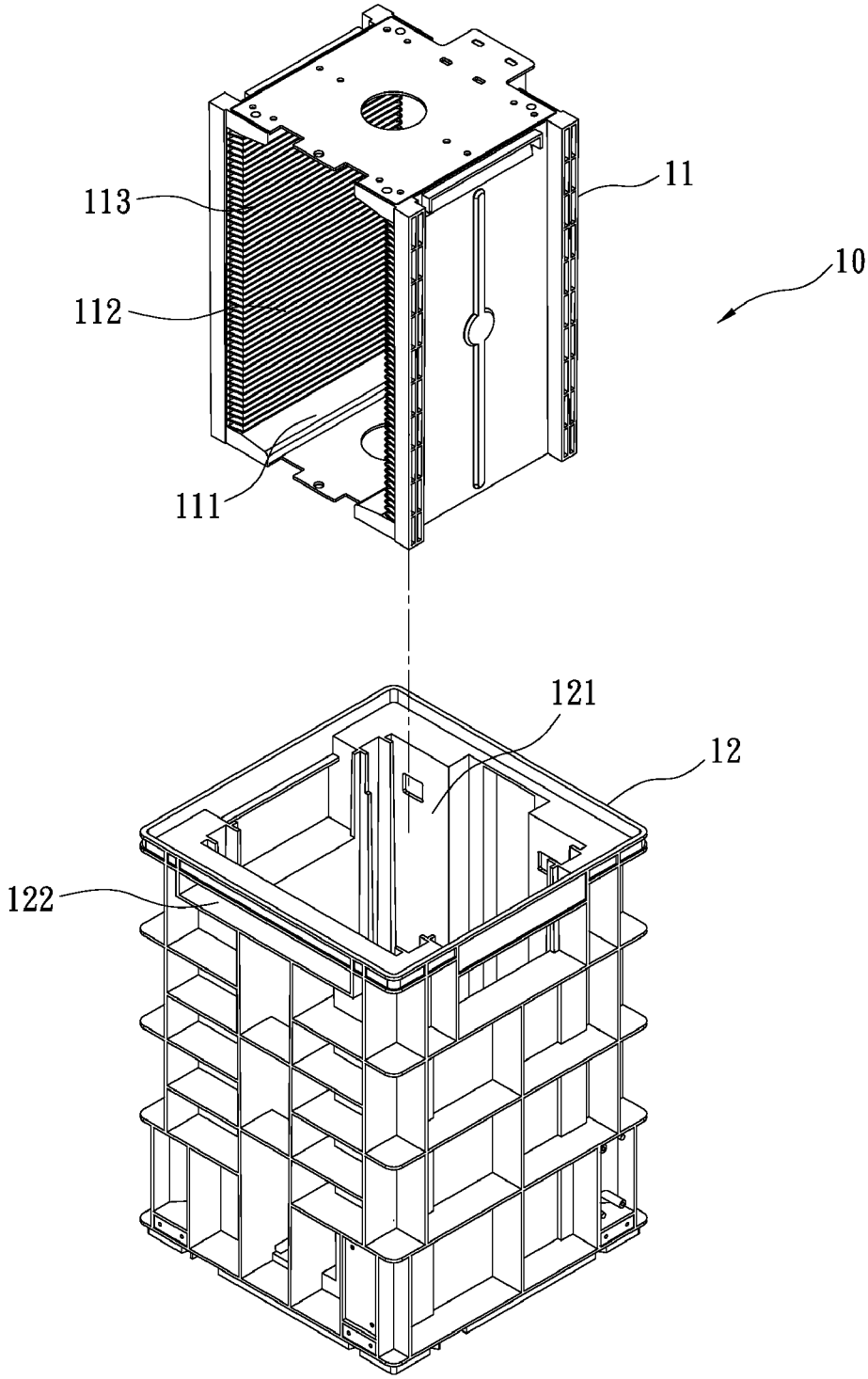
FIG. 4 is a perspective view of a cartridge according to the present invention.
Figure 5:
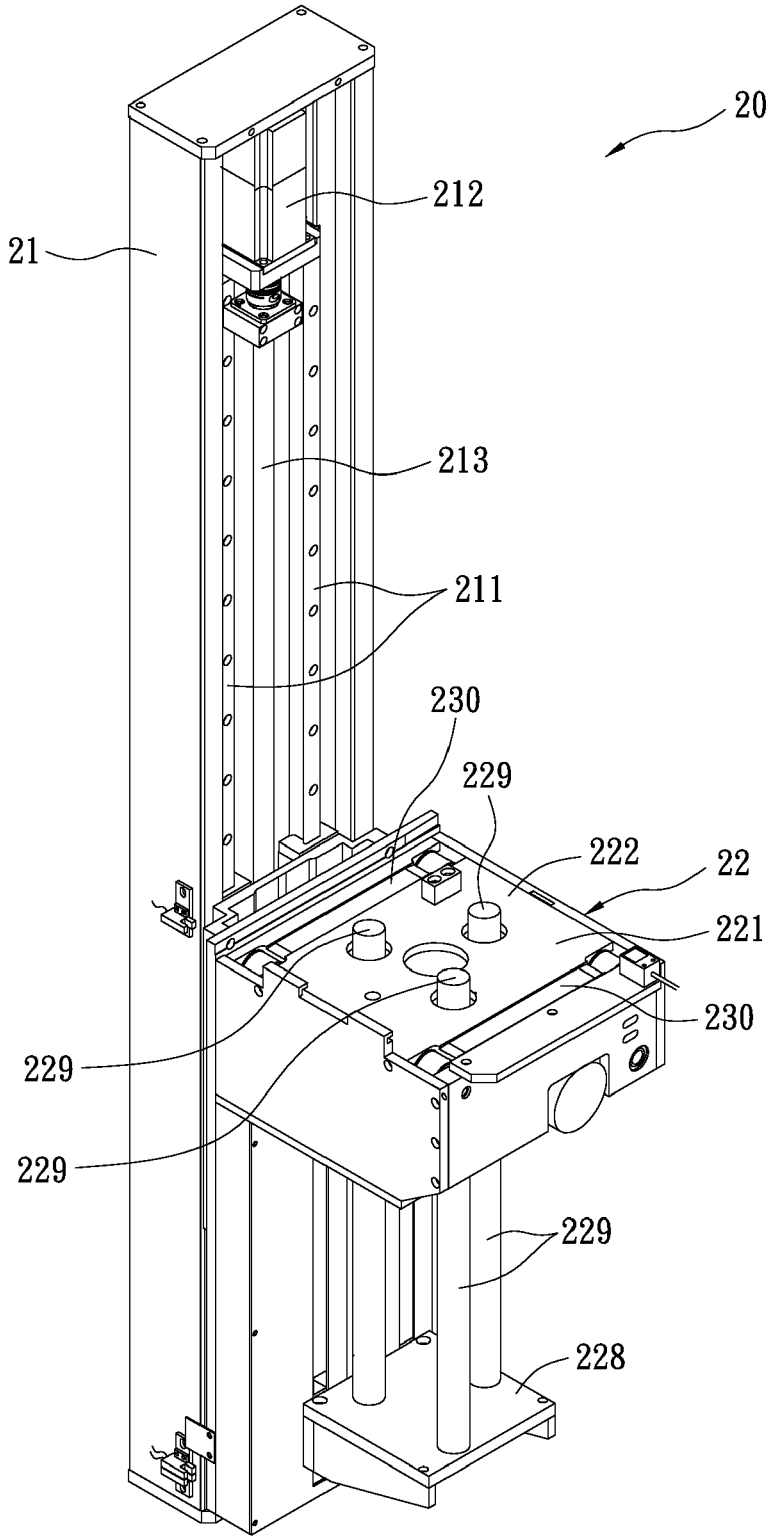
FIG. 5 is a perspective view of a cartridge lifting member according to the present invention.
Figure 6:
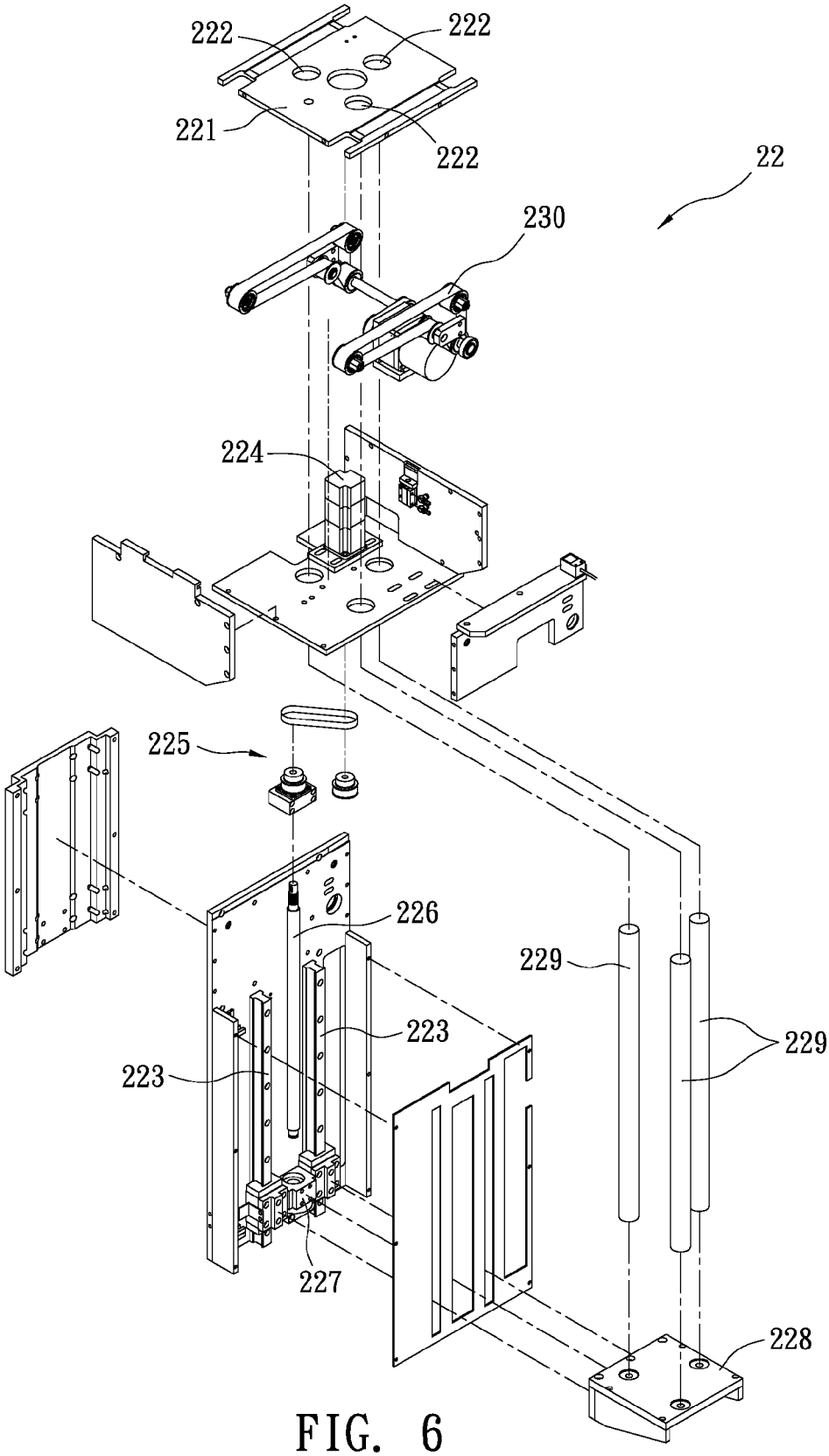
FIG. 6 is an explosive view of a cartridge transmission mechanism according to the present invention.

Refer to FIG. 4, the cartridge 10 consists of an inner box 11 and an outer box 12. The inner box 11 includes a receiving space 111 and an opening 112 on a front side of the receiving space 111, facing the shift mechanism 50. A plurality of seats 113 spaced at equal distance is arranged vertically on inner sides of the inner box 11 for setting printed substrate so that the printed substrate can be loaded in the cartridge 10. Another opening 121 is disposed on top surface of the outer box 12 for installing the inner box 11. A long slot 122 corresponding to the opening 112 of the inner box 11 is disposed on lateral sides of the outer box 12 so that the shift mechanism 50 can take out or put in the printed substrate from the cartridge 10 through the long slot 122. The cartridge 10 is moved up and down by the cartridge lifting members 20.

Refer from FIG. 2 to FIG. 6, the two lifting members 20 are arranged in parallel horizontally on the frame 2 and having a sliding rail post 21 and a cartridge transmission mechanism 22. The sliding rail post 21 is disposed with at least one guide rail 211 and a power part 212 such as a server, a stepper or a DC brushless motor. By the power part 212, a screw rod 213 rotates to synchronously drive the cartridge transmission mechanism 22 moving along the guide rail 211. The cartridge transmission mechanism 22 consists of a loading board 221 for loading a cartridge 10. At least one hole 222 corresponding to a cartridge supportive rod 229 is disposed on the loading board 211 while at least one guide rail 223 and at least one power part 224 such as server, stepper or a DC brushless motor are arranged under the loading board 221. The power part 224 drives a screw rod 226 rotating thereunder by a driving wheel 225. Thus a driving block 227 on the lower end of the screw rod 226 is also driven to slide vertically for further driving a cartridge supporting seat 228 on one side of the driving block 227 so that at least one cartridge supporting rod 229 arranged vertically on top of the cartridge supporting seat 228 synchronously slides along the guide rail 223. The top end of the cartridge supporting rod 229 inserts through the hole 222 on the loading board 221 and leans against the bottom side of the inner box 11 for driving the inner box 11 sliding vertically. The cartridge transmission mechanism 22 is further arranged with a transfer member 230 that transfers the cartridge 10 from the loading board 221 to the cartridge convey members 30.

Figure 2:
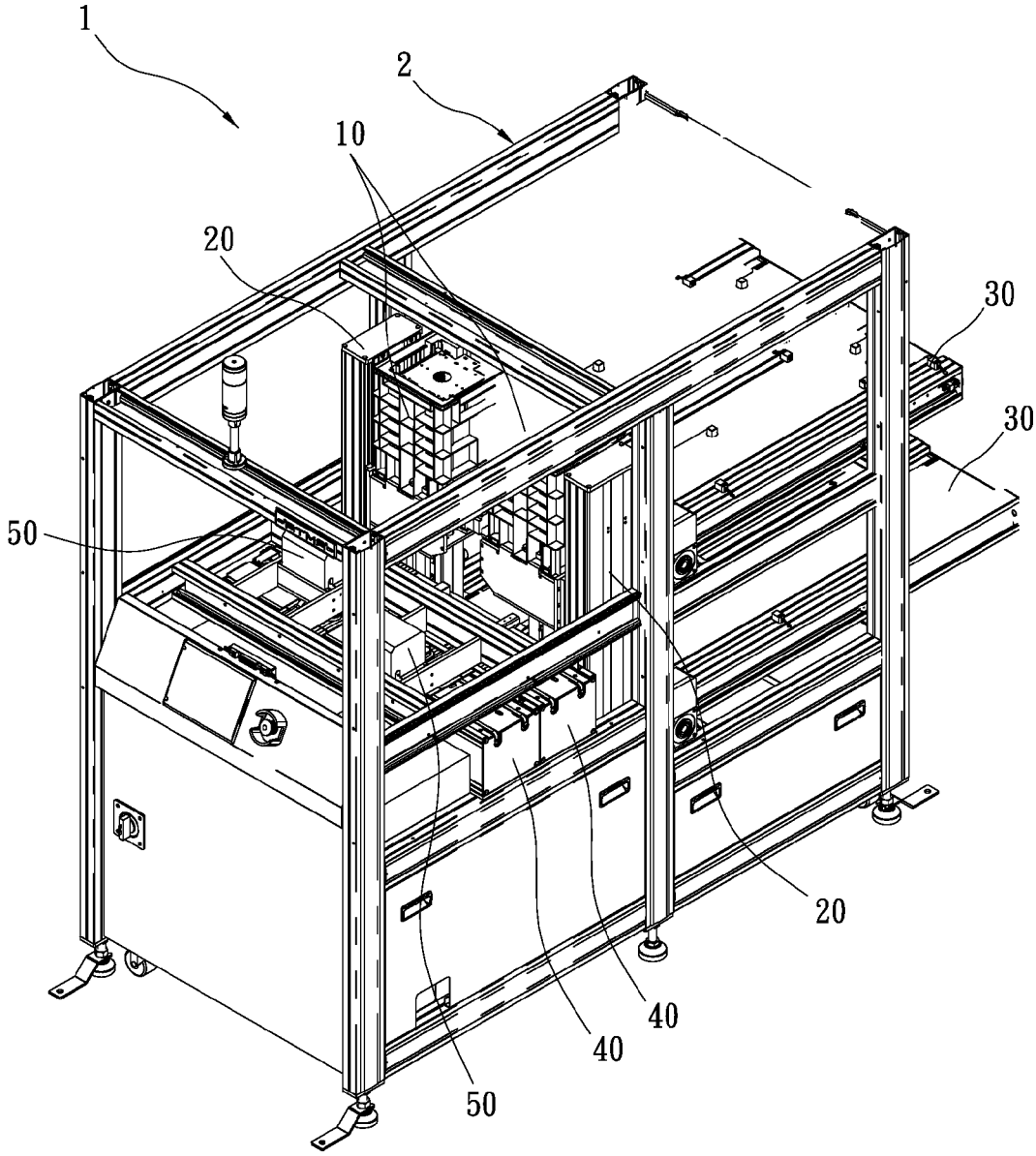
FIG. 2 is a perspective view of an embodiment according to the present invention.
Figure 3:
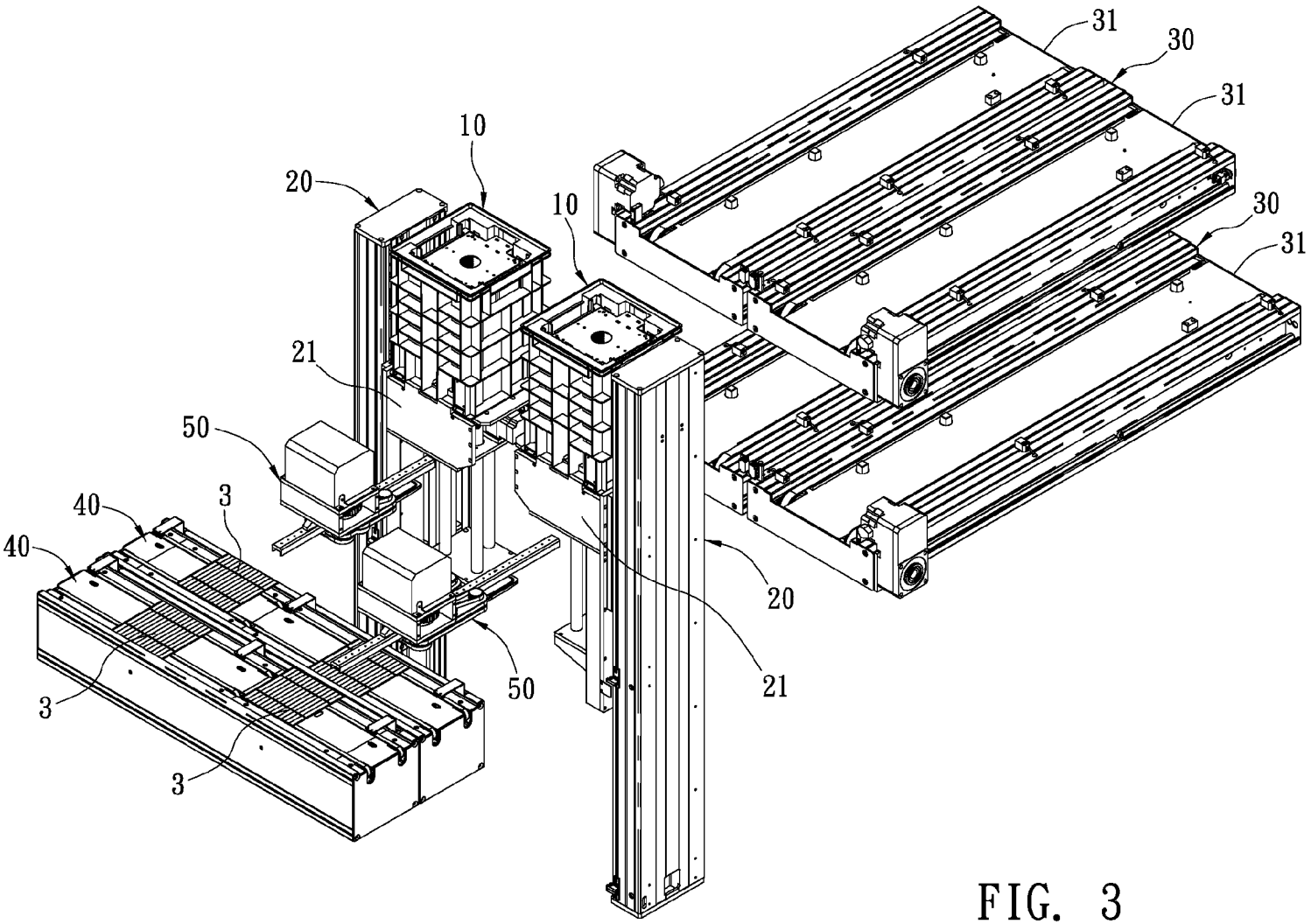
FIG. 3 is a partial explosive view of the embodiment in FIG. 2.
Figure 7:
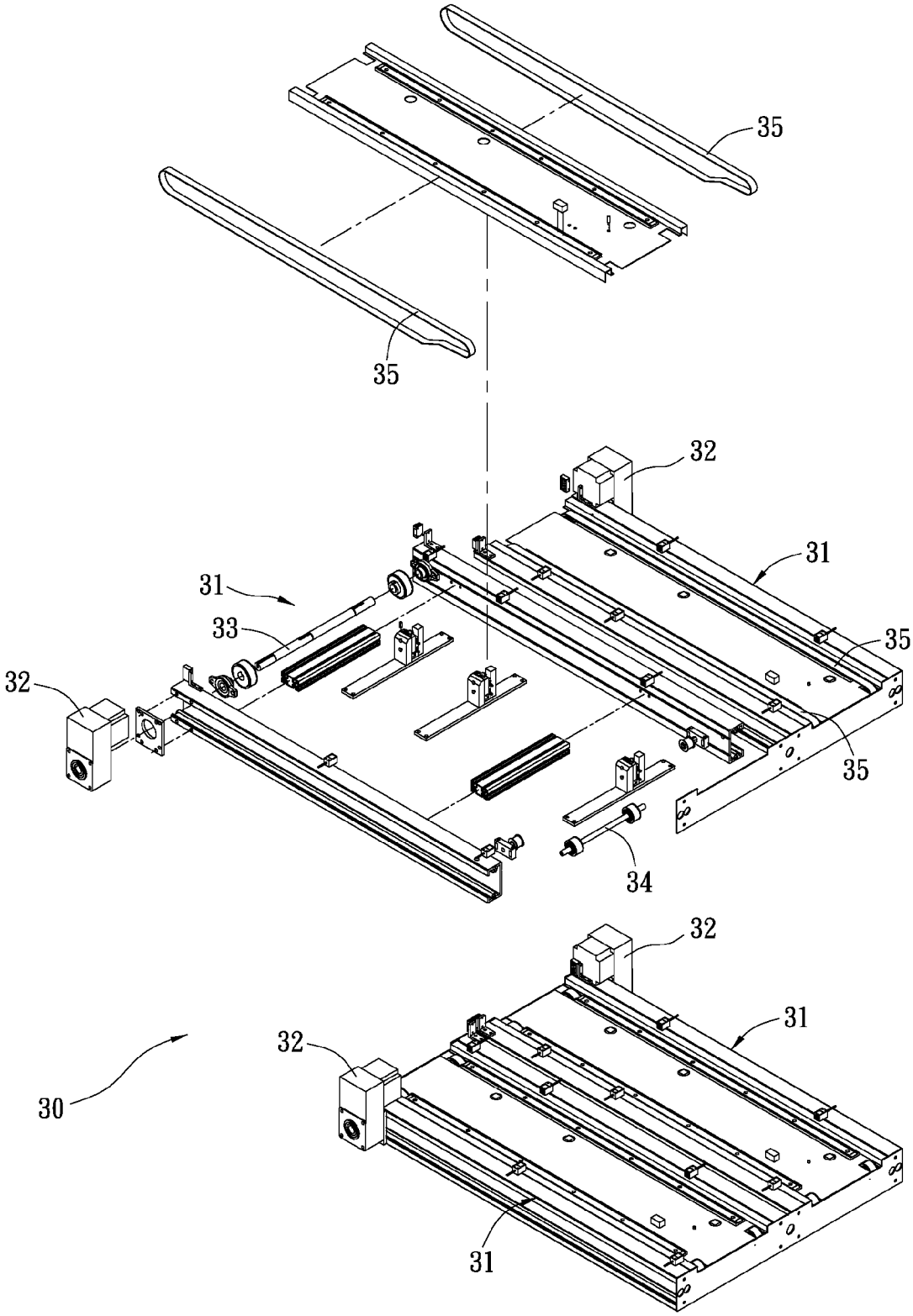
FIG. 7 is a partial explosive view of a cartridge convey member according to the present invention.

Refer to FIG. 2, FIG. 3 & FIG. 7, the cartridge convey members 30 are arranged at intervals vertically on the frame 2 at the rear side of the cartridge lifting members 20. The cartridge convey member 30 includes a plurality of convey belts 31 that uses a motor 32 to drive a driving shaft 33 so as to make a belt 35 rotates along the driving shaft 33 and a drive shaft 34 for delivering the cartridge 10 out of the cartridge lifting member 20.

Figure 8:
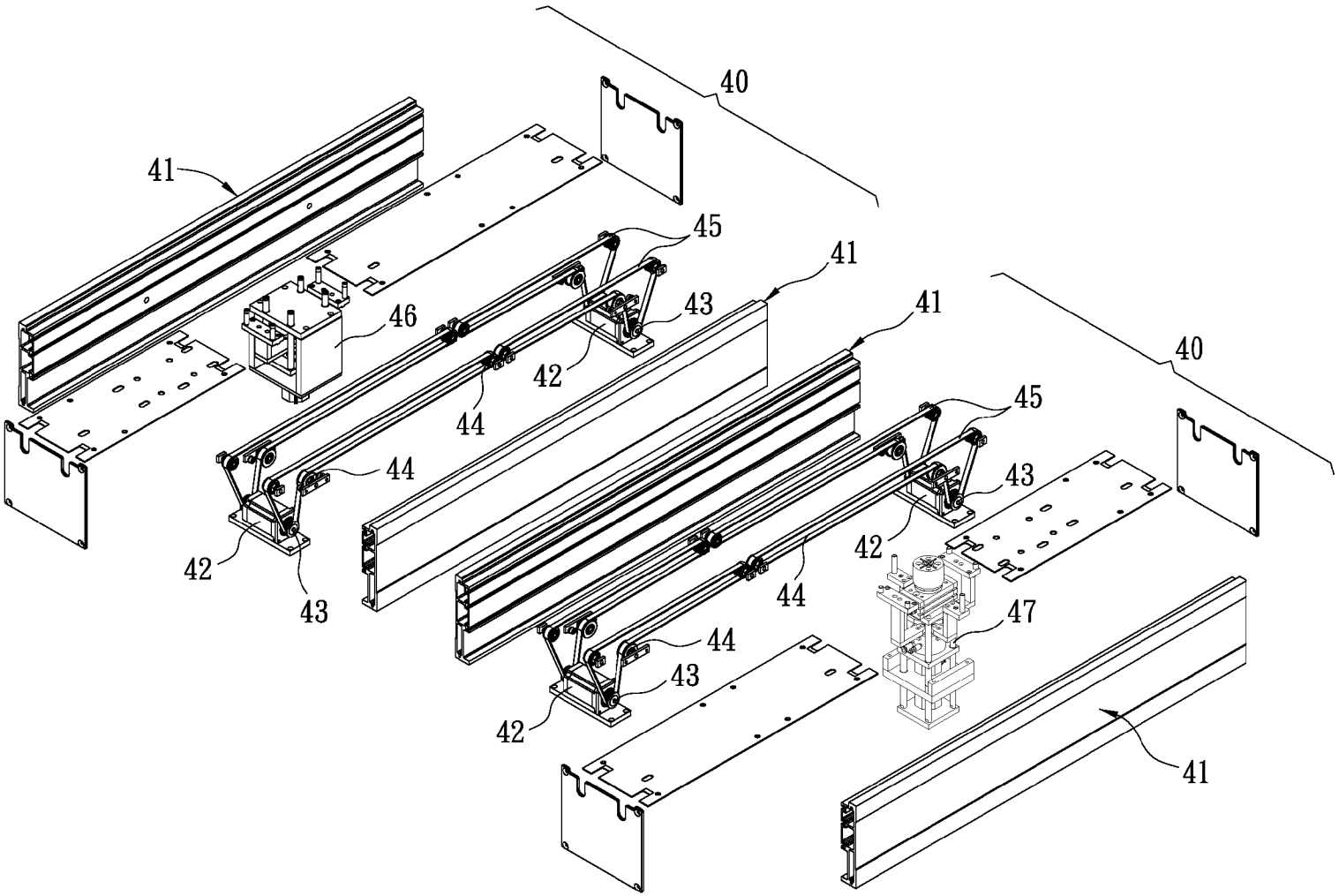
FIG. 8 is an explosive view of a printed substrate convey member according to the present invention.

Refer to FIG. 2, FIG. 3 & FIG. 8, the printed substrate delivery members 40 arranged on the frame 2, in front of the cartridge lifting members 20 consists of a delivery seat 41 and at least one motor 42 disposed therein for driving a drive shaft 43 so as to make a convey belt 45 rotates along a driving wheel 34 as well as corresponding driven wheels 44. Thus articles to be printed 3 on the printed substrate delivery members 40 are delivered to operation area of printing or storage.

Figure 9:
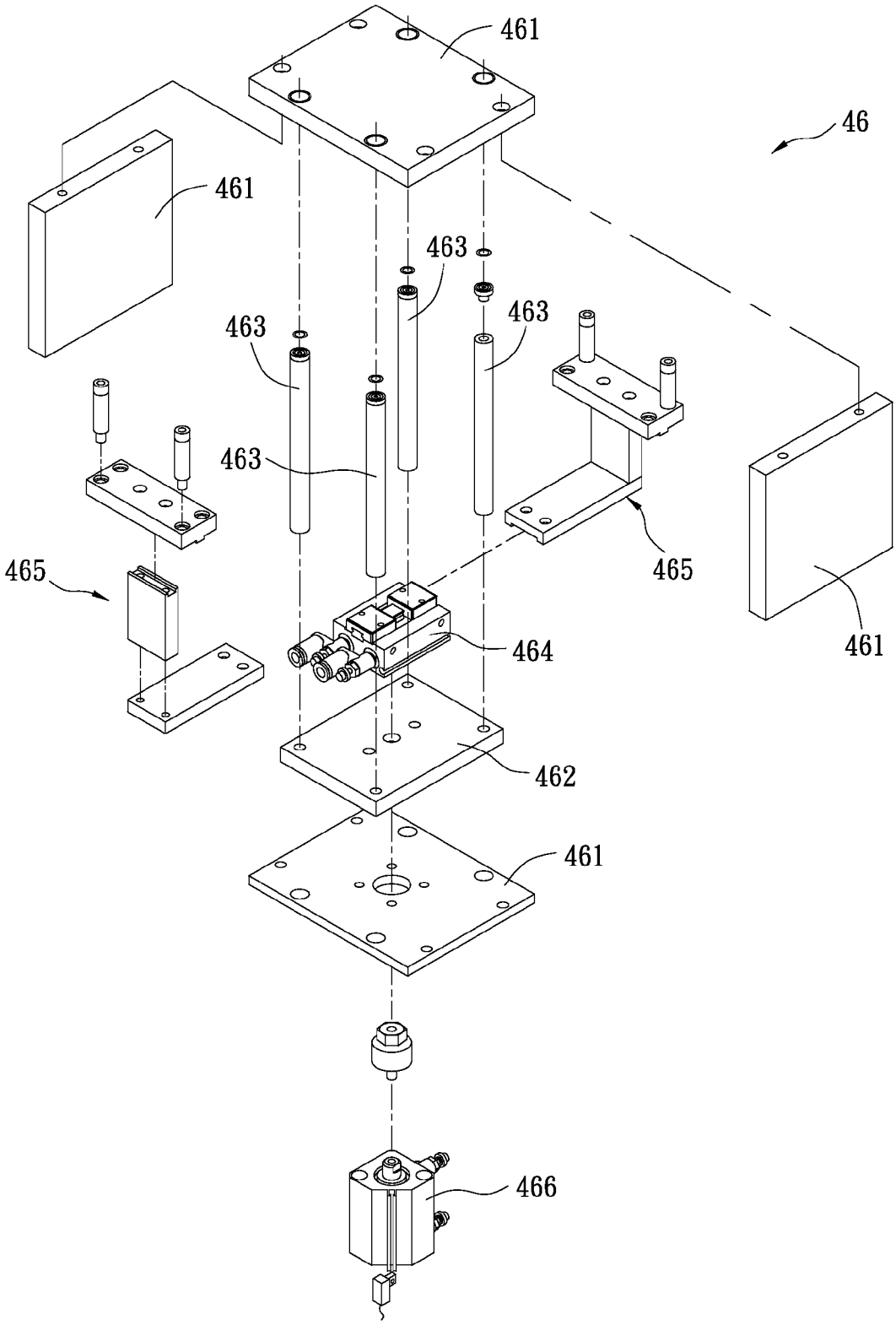
FIG. 9 is an explosive view of a supporting setting member according to the present invention.

Refer to FIG. 8 & FIG. 9, the delivery seat 41 of the printed substrate delivery members 40 is further disposed with a supporting setting member 46 having a base 461, a moving plate 462 with a plurality of supportive axes 463 around, a first cylinder 464 with two symmetrical positioning axes 465 arranged on the middle part, and a second cylinder 466 connected with a bottom side of the base 461 and an axial center of the second cylinder 466 corresponds to that of the bottom side of the moving plate 462. In use, the symmetrical positioning axis 465 is driven and moved horizontally by the first cylinder 464. By the second cylinder 466, the moving plate 462 and the supportive axes 463 are moved vertically. Thus position of the articles to be printed 3 on the printed substrate delivery members 40 are adjusted in horizontal and vertical directions. Therefore, positioning is achieved.

Figure 10:
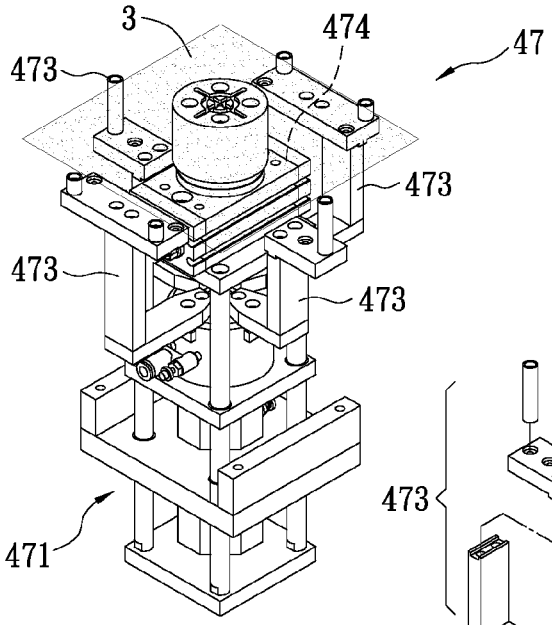
FIG. 10 is a perspective view of a lifting setting rotation member according to the present invention.
Figure 11:
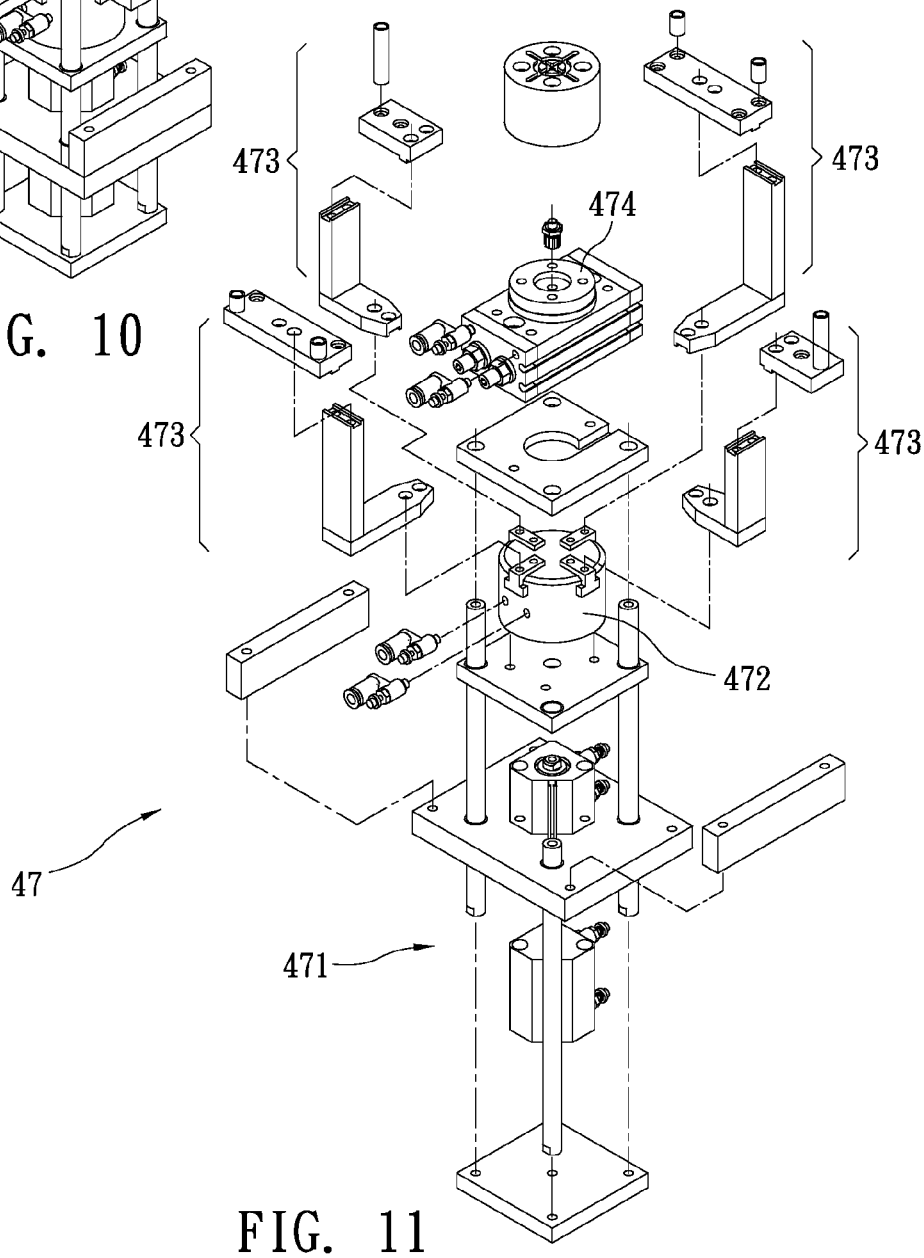
FIG. 11 is an explosive view of the lifting setting rotation member in FIG. 10.

Refer to FIG. 8, FIG. 10 & FIG. 11, the delivery seat 41 is further arranged with a lifting setting rotation member 47 that includes a base 471, a clamp cylinder 472 and a twist cylinder 474. The clamp cylinder 472 is connected with a plurality of symmetrically-arranged positioning axes 473 for receiving the articles to be printed 3. In use, the symmetrically-arranged positioning axis 473 is driven by the clamp cylinder 472 to move and contract horizontally for clipping the articles to be printed 3. Then by the twist cylinder 474, the articles 3 are rotated to perform printing processes. This is especially important for articles to be printed 3 with slant lines that requires rotation for convenience of printing.

Figure 12:
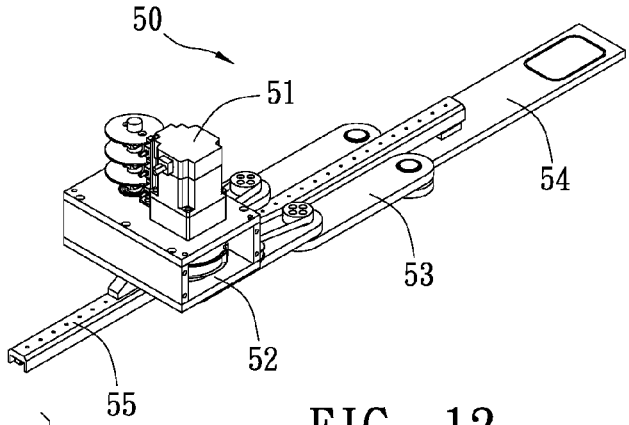
FIG. 12 is a perspective view of a shift mechanism according to the present invention.
Figure 13:
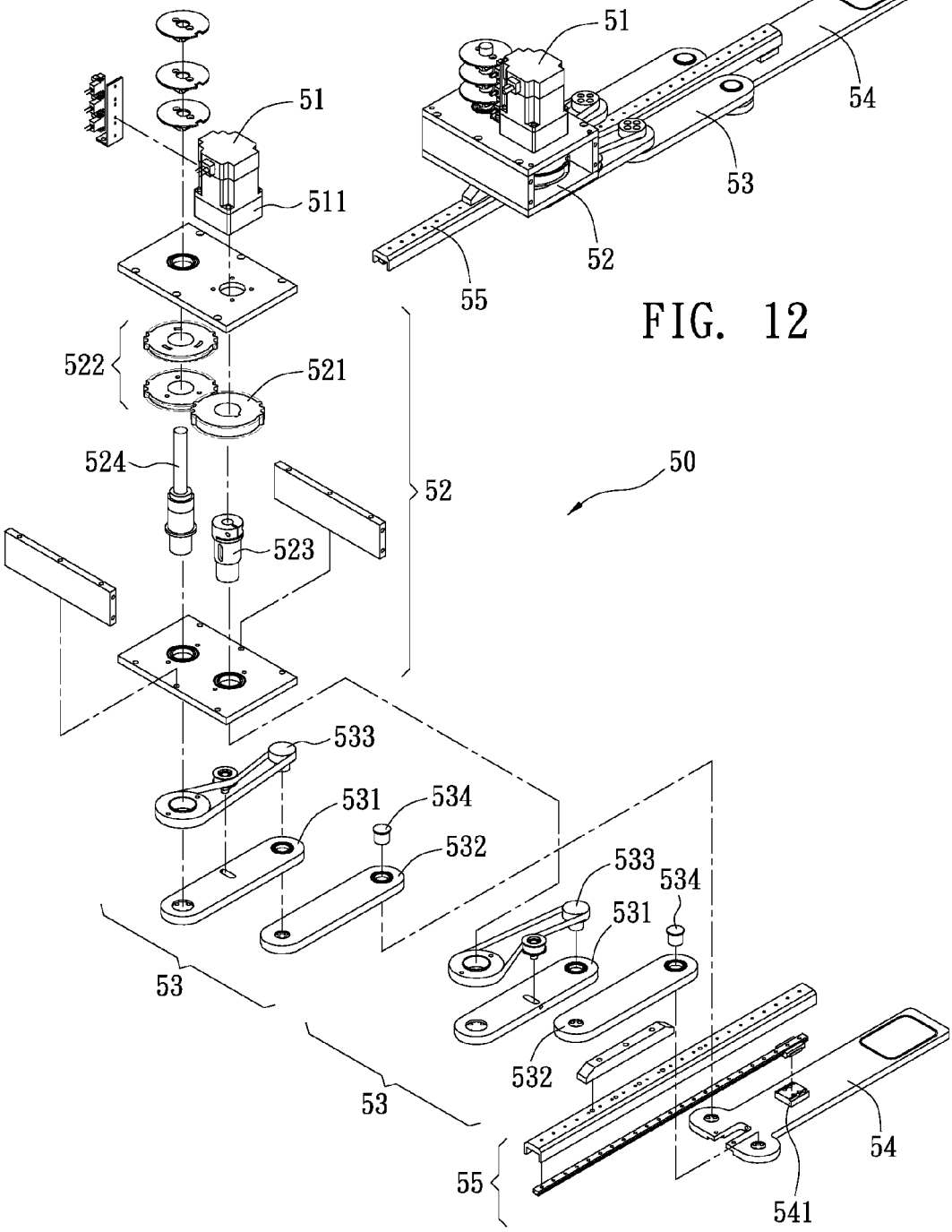
FIG. 13 is an explosive view of the shift mechanism in FIG. 12.

Refer to FIG. 2, FIG. 3, FIG. 12 & FIG. 13, the two shift mechanisms 50 arranged on the frame 2 respectively correspond to the cartridge 10 and the printed substrate delivery members 40 for taking out/putting in the articles to be printed 3 from/to the cartridge 10 and the printed substrate delivery members 40. The shift mechanism 50 is composed of a power part 51 with a reducer 511 that is connected with a gear mechanism 52 downwards. The gear mechanism 52 consists of a driving gear 521 and a matched driven gear 522 that respectively connect with movable arms 53 by a driving shaft 523 and a driven shaft 524. The movable arm 53 includes a lever arm 531 connected with a rotating arm 532 by a rotation wheel 533. Moreover, the two movable arms 53 respectively connect with a material-taking arm 54 by a driving shaft center 534. The material-taking arm 54 is connected with and moved linearly on a guide rail seat 55 by a guide seat block 541, as shown in FIG. 12 & FIG. 13. The driving gear 521 and the driven gear 522 are driven and rotated by the power part 51 so that the lever arm 531 of the movable arm 53 drives the rotating arm 532 in a link motion while the driving shaft 523 and the driven shaft 524 are used as pivot points and the rotation wheel 533 works as a fulcrum.

The material-taking arm 54 is further driven by the rotating arm 532 to move linearly along the guide rail seat 55 so as to put the articles to be printed 3 in the cartridge 10 into the printed substrate delivery members 40 or move the articles in the opposite direction. Furthermore, the driven gear 522 of the present invention is formed by two gears arranged vertically and a bit staggered. That means the teeth on the upper gear and the lower gears are not precisely corresponding or overlapping to each other so that the driving gear 521 can lock between the teeth of the driven gear 522 and the clearance is reduced. Thus the performance of the gears 521, 522 is improved. Therefore, the material-taking arm 54 can move forward/backward precisely.

Figure 14:
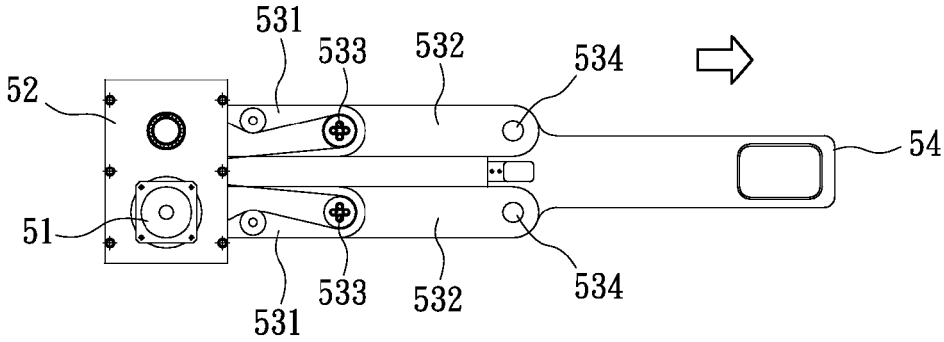
FIG. 14-16 are schematic drawings showing a material-taking arm of the shift mechanism moving forward, backward and backward further according to the present invention.
Figure 15:
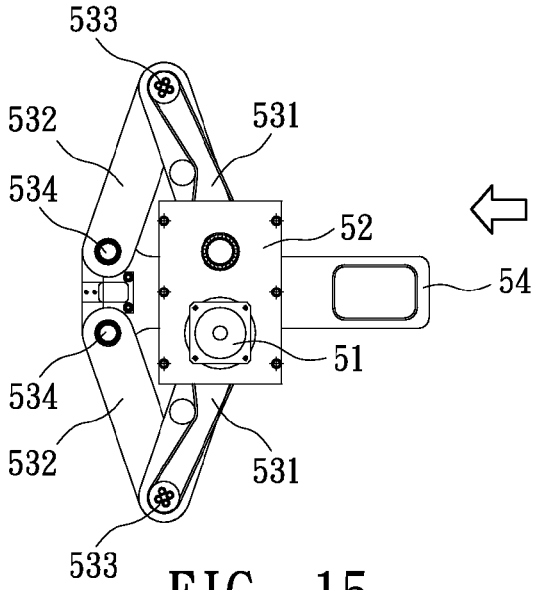
Figure 16:
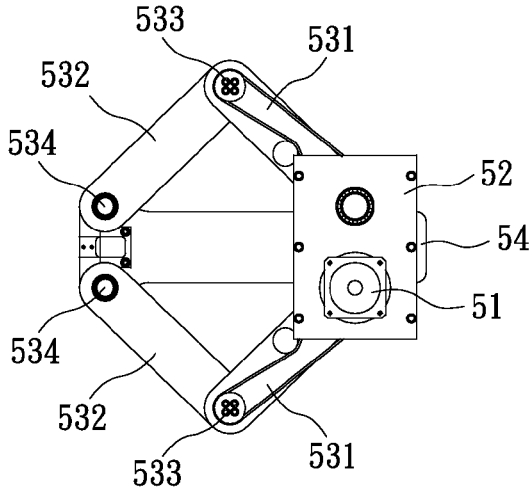

The shift mechanisms 50 drives the movable arm 53 by the power part 51 and the movable arm 53 drives the material-taking arm 54 by a link motion to move forward linearly into the cartridge 10 for taking in/out the articles to be printed 3 from the printed substrate delivery members 40, as shown in FIG. 14, or to move backward linearly for taking in/out the articles to be printed 3 from the printed substrate delivery members 40, as shown in FIG. 15. Refer to FIG. 16, the material-taking arm 54 can move backward further to the position outside the cartridge 10 and the printed substrate delivery members 40.

In use, the cartridge convey member 30 moves the cartridge 10 to the cartridge lifting member 20. The cartridge lifting member 20 moves vertically along with the shift mechanism 50 to take out the objects to be printed 3 in the cartridge 10 and put them into the printed substrate delivery members 40. Thus the objects to be printed 3 are delivered to the operation area of printing so as to form a work line for automatic feeding. Moreover, the shift mechanism 50 can also pick up the objects to be printed 3 on the printed substrate delivery members 40 and put them into the cartridge 10 so as to form a work line for automatic collection. Furthermore, by the cartridge convey member 30, the collected cartridge 10 is delivered to storage area so as to form a work line for storage. Thereby, each work line can perform material feeding, collection and storage respectively. And by the two work line respectively running material feeding, collection and storage, the automatic screen printing production line can achieve automatic material feeding, collection and storage. When the production line needs to be suspended for washing, maintenance, and trouble shooting, it continues to function for material feeding and collection by the present invention and there is no need to shot down the device.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A cartridge device applied to production lines for automatic screen printing comprising a frame, a plurality of cartridges, two cartridge lifting members, two cartridge convey members, two printed substrate delivery members and two shift mechanisms, wherein:

the frame is a metal rack;

each one of the plurality of cartridges having an inner box and an outer box while a long slot corresponding to an opening of the inner box is disposed on a front side of the outer box;

the two cartridge lifting members are arranged in parallel horizontally on the frame and each cartridge lifting member having a sliding rail post and a cartridge transmission mechanism slidingly arranged on a guide rail of the sliding rail post so that the cartridge is set on and moves along with the cartridge transmission mechanism;

the two cartridge convey members corresponding to one of the cartridges are arranged at intervals vertically on the frame at the rear side of the two cartridge lifting members for delivering the cartridge out of each one of the two cartridge lifting members;

the two printed substrate delivery members are arranged in front of the two cartridge lifting members for delivering articles to be printed to operation area of printing or storage of the production line;

the two shift mechanisms arranged on the frame, corresponding to one of the cartridges and one of the printed substrate delivery members take out or put in the articles to be printed from one of the cartridges through the long slot of the outer box and deliver the articles to be printed between one of the cartridges and one of the printed substrate delivery members;

wherein by one of the shift mechanisms, the articles to be printed on a work line of the production line are moved from one of the printed substrate delivery members to one of the cartridges for material collection and storage or from one of the cartridges to one of the printed substrate delivery members for material feeding so that the two work lines of the production line perform automatic material feeding, collection and storage simultaneously or respectively.

2. The device as claimed in claim 1, wherein the inner box is disposed with a receiving space and the opening is on the front side of the receiving space, facing one of the shift mechanisms; a plurality of seats spaced at equal distance is arranged vertically on inner sides of the inner box for loading articles to be printed.

3. The device as claimed in claim 1, wherein the sliding rail post of each one of the cartridge lifting members is disposed with a power part that drives a screw rod to rotate for synchronously driving the cartridge transmission mechanism to move along the guide rail of the sliding rail post.

4. The device as claimed in claim 1, wherein the cartridge transmission mechanism having a loading board for loading a cartridge and at least one hole is disposed above the loading board while at least one guide rail and at least one power part are arranged under the loading board; the lower part connects with a driving block on the lower end and a cartridge supporting seat is on one side of the driving block with at least one cartridge supporting rod arranged vertically on top thereof; the top end of the cartridge supporting rod inserts through the hole on the loading board and leans against a bottom side of the inner box; while the power part rotating, the cartridge supporting seat and the cartridge supporting rod are driven by the screw rod to move vertically along the guide rail so as to drive the inner box moving vertically.

5. The device as claimed in claim 1, wherein the cartridge transmission mechanism is further arranged with a transfer member that delivers one of the cartridges from the cartridge transmission mechanism to one of the cartridge convey members.

6. The device as claimed in claim 1, wherein each one of the cartridge convey members having a plurality of convey belts that includes a motor and a belt driven by the motor.

7. The device as claimed in claim 1, wherein each one of the printed substrate delivery members includes a delivery seat and at least one motor and a convey belt driven by the motor.

8. The device as claimed in claim 1, wherein each one of the shift mechanisms further includes a power part connected with a gear mechanism downwards that having a driving gear and a matched driven gear, respectively connects with a movable arm by a driving shaft and a driven shaft; the tow movable arms respectively connect with a material-taking arm by a driving shaft center so as to make the material-taking arm move linearly on a guide rail seat.

9. The device as claimed in claim 1, wherein each one of the printed substrate delivery members is further disposed with a supporting setting member that having a base, a moving plate inside the base, a first cylinder symmetrically connected with two positioning axes, and a bottom side of the base is connected with a second cylinder for being connected with the bottom side of the moving plate; when the first cylinder and the second cylinder act, the positioning axis is driven and moved horizontally and vertically so as to adjust and position the articles to be printed on each one of the printed substrate delivery member.

10. The device as claimed in claim 1, wherein each one of the printed substrate delivery members is further arranged with a lifting setting rotation member that includes a base, a clamp cylinder over the base and being connected with a plurality of symmetrically-arranged positioning axes for receiving the articles to be printed, and a twist cylinder for clipping and driving the articles to be printed to rotate.

* * * * *